United States Patent [19]

Giese et al.

[11] 4,316,335

[45] Feb. 23, 1982

[54] ATHLETIC SHOE CONSTRUCTION

[75] Inventors: Erik O. Giese, Key Biscayne, Fla.; Alexander L. Gross, Aspen, Colo.

[73] Assignee: Comfort Products, Inc., Aspen, Colo.

[21] Appl. No.: 221,068

[22] Filed: Dec. 29, 1980

Related U.S. Application Data

[63] Continuation of Ser. No. 27,313, Apr. 5, 1979, abandoned.

[51] Int. Cl.[3] ..... A43B 13/18; A43B 21/16; A43B 23/28; A43B 5/06

[52] U.S. Cl. ..... 36/129; 36/28; 36/32 R; 36/57 R

[58] Field of Search ..... 36/28, 32 R, 32 A, 59 R, 36/59 A, 35 R, 37, 129

[56] References Cited

U.S. PATENT DOCUMENTS

| | | | |
|---|---|---|---|
| 532,429 | 1/1895 | Rogers | 36/28 |
| 699,549 | 5/1902 | McIntyre | 36/28 |
| 925,354 | 6/1909 | Lambert | 36/29 |
| 1,362,229 | 12/1920 | Colburn | 36/28 |
| 1,559,532 | 10/1925 | Smith | 36/28 |
| 1,841,942 | 1/1932 | Fenton | 36/28 |
| 1,976,389 | 10/1934 | Everston | 36/28 |
| 2,055,072 | 9/1936 | Everston | 36/28 |
| 2,132,882 | 10/1938 | Rigandi | 36/30 R |
| 2,374,487 | 4/1945 | Jayne | 36/32 R |
| 2,502,774 | 4/1950 | Alianiello | 36/28 |
| 3,341,952 | 9/1967 | Dassler | 36/129 |
| 3,822,490 | 7/1974 | Marawski | 36/35 R |
| 3,834,046 | 9/1974 | Fowler | 36/28 |
| 4,043,058 | 8/1977 | Hollister et al. | 36/28 |
| 4,067,123 | 1/1978 | Minihane | 36/32 R |
| 4,098,011 | 7/1978 | Bowerman et al. | 36/32 R |
| 4,102,061 | 7/1978 | Saaristo | 36/28 |
| 4,128,950 | 12/1978 | Bowerman et al. | 36/30 R |

FOREIGN PATENT DOCUMENTS

| | | | |
|---|---|---|---|
| 2336314 | 6/1975 | Fed. Rep. of Germany | 36/28 |
| 2336314 | 6/1975 | Fed. Rep. of Germany | 36/28 |
| 246346 | 3/1928 | Italy | 36/28 |
| 517532 | 2/1940 | United Kingdom | 36/28 |
| 1444091 | 7/1976 | United Kingdom | 36/28 |

*Primary Examiner*—Patrick D. Lawson
*Attorney, Agent, or Firm*—Pennie & Edmonds

[57] ABSTRACT

An athletic shoe which has a light-weight and readily flexible sole construction including shock absorbing portions in the heel and forefoot areas of the sole having different shock absorbing porperties with the shock absorbing portion in the heel area having a shock absorbing property greater than that in the forefoot area. Flexible nubs are included on the sole for traction and cushioning purposes where the spacing between nubs in heavy load bearing areas of the sole is less than the spacing between nubs in light load bearing areas of the sole. The nubs are positioned to facilitate flexing of the sole along normal breaklines corresponding to the joints of the foot of a wearer. The heel portion of the sole may include a cut out forming in part a vertically extending deflection rib surrounding a shock absorbing portion to further enhance shock absorbing, cushioning and propulsion properties.

15 Claims, 12 Drawing Figures

ATHLETIC SHOE CONSTRUCTION

This is a continuation of application Ser. No. 27,313, filed Apr. 5, 1979, now abandoned.

TECHNICAL FIELD

The invention relates to an athletic shoe construction including shock absorbing portions on the heel and forefoot areas of the sole of the shoe as well as a particular placement of flexible nubs on the sole to facilitate flexing along lines corresponding to the joints of a foot of a wearer.

BACKGROUND ART

An important feature in athletic shoes, particularly in running shoes, is to provide for an extremely lightweight construction while at the same time provide for support of the foot and for cushioning of the foot as the foot contacts the ground under varying loads. It is known that a runner's foot contacting the ground engages the ground first with the heel, then with the side of the foot and then with the forefoot. The shock recorded at the heel and forefoot upon contacting the ground while running can be extremely high, on the order of 3 g's while the shock recorded in jumping sports, for example basketball, may be as high as 7 g's. Because, particularly in the case of running shoes, the time that the heel contacts the ground is less than that when the forefoot contacts the ground, the intensity of the shock recorded by the heel is greater than that recorded by the forefoot. While prior art shoe constructions have included shock absorbing portions, such portions have not been placed in the area of the shoe subjected only to shock, or have the prior art constructions taken into account that the shock load varies over different areas of the sole portion of a shoe, or even that shock loads will vary due to the particular exercise for which the shoe is designed, i.e. basketball shoes compared with running shoes.

Heretofore athletic shoes have included various sole constructions having flexible nubs positioned evenly across the bottom of the sole. This results in an excess of nubs, and thus weight, in areas of the sole subjected to low g loading, as for example the inside of the arch area of the sole and, in some instances, results in not enough nubs being positioned in high load bearing areas. This is evidenced in that the few nubs positioned in high load bearing areas quickly wear due to uneven load distribution both in the vertical compression direction and in the horizontal shear direction. Further the nubs that have been used on athletic shoes to date have failed to take into account the need of placement and design of the nubs so as to facilitate easy flexing of the sole along lines which correspond to the joints of the foot of the wearer. This is an extremely important feature in running where it is important that as little effort and energy as possible be expended in flexing of the sole of the shoe.

It is therefore an object of our invention to provide for an athletic shoe construction that will be extremely light in weight but which at the same time will provide sufficient shock absorbing portions at those areas of the sole portion of the shoe subjected to shock loads and which also will compensate for differences in shock loads occurring between various area of the sole portion. In addition it is an object of the invention to provide for a tread design including placement and configuration of nubs on the outer sole of the shoe to provide a minimum weight penalty while providing additional cushioning features and easy flexing of the sole portion.

DISCLOSURE OF INVENTION

Broadly an athletic shoe constructed according to the invention comprises a sole portion connected to a conventional upper portion and where the sole portion includes heel, arch and forefoot areas. The heel area includes a first shock absorbing portion having a particular shock absorbing property and the forefoot area includes a second shock absorbing portion having a shock absorbing property less than that of the heel area.

In one form of the invention adapted particularly for a running shoe, the sole portion comprises in part a combination of an outer sole, a mid-sole and a wedge where the wedge is contained in the heel area of the sole portion and where the mid-sole overlies the heel, arch and forefoot areas of the sole portion as well as the wedge. The heel and forefoot areas contain an insertable shock absorbing portion tailored to fit the specific needs of each area with respect to degrees of hardness determined by the weight of an average sized athlete using a shoe of a particular size. Of course, the inserts can also be specifically designed as a function of the particular wearer's weight. The shock absorbing portion included in the forefoot area is softer than that included in the heel area and is sufficient to support a shock load of 3 g's of the weight of the wearer. A heel wedge having a hardness greater than the first shock absorbing portion overlies the arch and heel areas and the first shock absorbing portion is positioned in the heel wedge. A mid-sole overlies the forefoot area and the heel wedge and is comprised of a softer material than the shock absorbing material contained in the heel area and the second shock absorbing portion is positioned in the mid-sole of the forefoot area. The sole portion may also include an innersole of a comparatively stiff shoe lasting material which overlies the mid-sole and shock absorbing portions. Preferably the innersole has score lines extending substantially laterally in the area of the sole corresponding to the joint between the metatarsus and phalanges of the foot of the wearer to facilitate flexing of the sole along a breakline corresponding to the joint. In addition longitudinally extending score lines may intersect with the laterally extending score lines to facilitate deformation of the lasting material so that the innersole may easily engage the top of the shock absorbing portion.

Preferably the shock absorbing portions are constructed of materials which will have a compression set after a reasonable period of use such that the shock absorbing portions become self-conforming increasing comfort and stability to the wearer.

The outersole has flexible nubs on its outer side where the spacing between the nubs varies such that in load bearing areas of the sole, namely the heel and forefoot areas, the nubs are placed substantially closer together than in other non-load bearing areas, such as the arch. The nubs have a circular shape except those nubs in the area of the breakline of the sole between the metatarsus and the phalanges of the wearer where the nubs are elliptical in shape with the major axis of the ellipsis extending parallel to the breakline. This further increases flexibility of the sole as well as wear and traction characteristics.

In a further embodiment of the invention a mid-sole forming part of the sole portion extends over the heel, arch and forefoot areas of the sole portion and is made up of different materials having different shock absorbing properties such that the area of the mid-sole overlying the heel area comprises a first shock absorbing portion and the area of the mid-sole overlying the forefoot area comprises a second shock absorbing portion and where the second portion has lesser shock absorbing properties than the first portion.

In a still further form of the invention the sole portion may comprise a combination of a sole shell having a cavity therein to receive an insert comprising a shock absorbing material. In this form, the cavity in the sole portion extends over the heel, arch and forefoot areas and the thickness of the insert received in the cavity in the heel area is greater than the thickness of the insert in the forefoot area so that the shock absorbing properties in the heel area will be greater than that in the forefoot area. A further variation of use of a sole shell having a cavity to receive an insert of a shock absorbing material is to combine the insert with a mid-sole made of the same shock absorbing material and to make the thickness of the insert greater in the heel area than in the forefoot area.

In a further separate embodiment of the invention, the shock absorbing portion in the heel area of the sole is contained within a cut out portion of the sole which includes an upstanding deflection flange or rib which engages with the outer periphery of the shock absorbing portion and which is spaced from the side walls of the cut out. The upstanding deflection rib extends above the shock absorbing portion and supports a shoe lasting material which, in a non-shock load condition, is spaced from the shock absorbing portion and which, in a heavy shock load position, engages the shock absorbing portion. This further increases the shock absorbing properties of the heel portion and provides a propulsive force when the shock load is removed and the deflection rib springs back to its normal upright position.

BEST MODE FOR CARRYING OUT THE INVENTION

Figure 1:
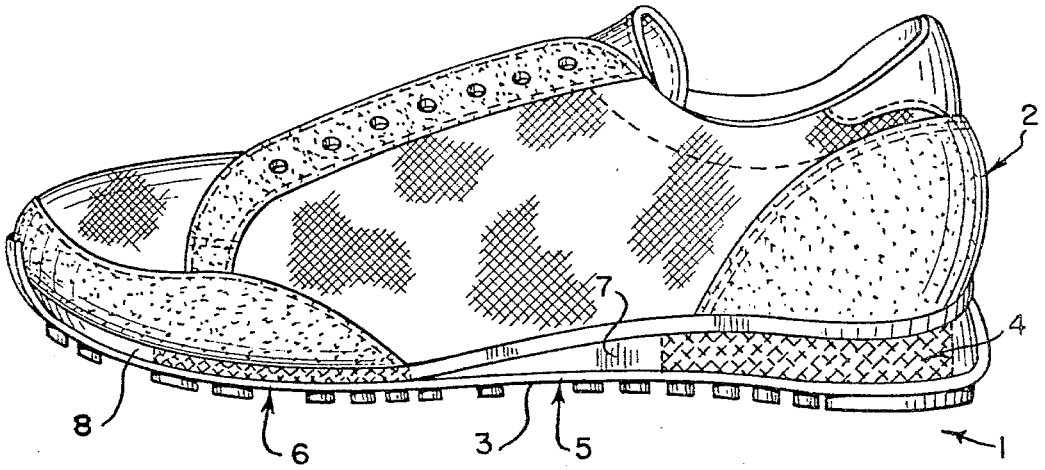
FIG. 1 is a side view of an athletic shoe constructed according to the invention.
Figure 2:
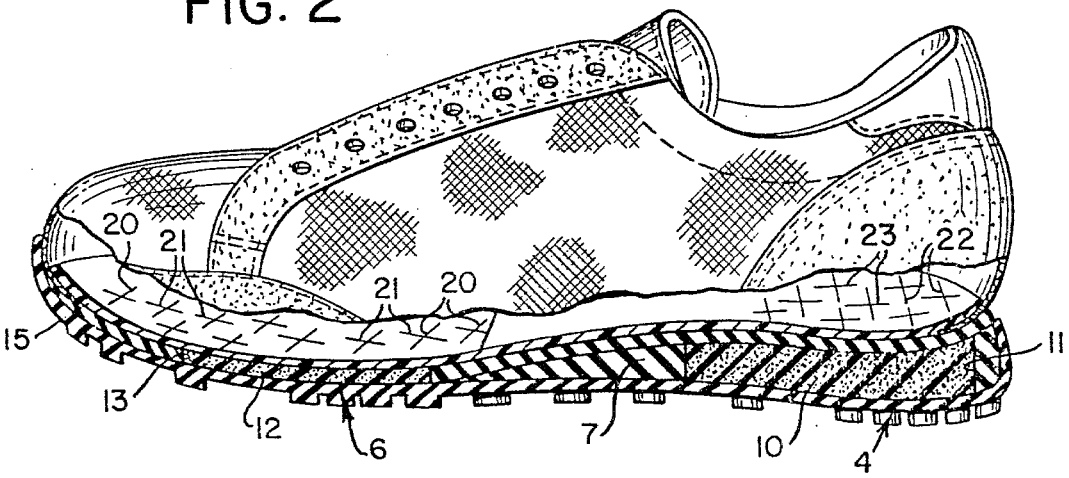
FIG. 2 is a sectional view of a portion of the shoe shown in FIG. 1.
Figure 3:
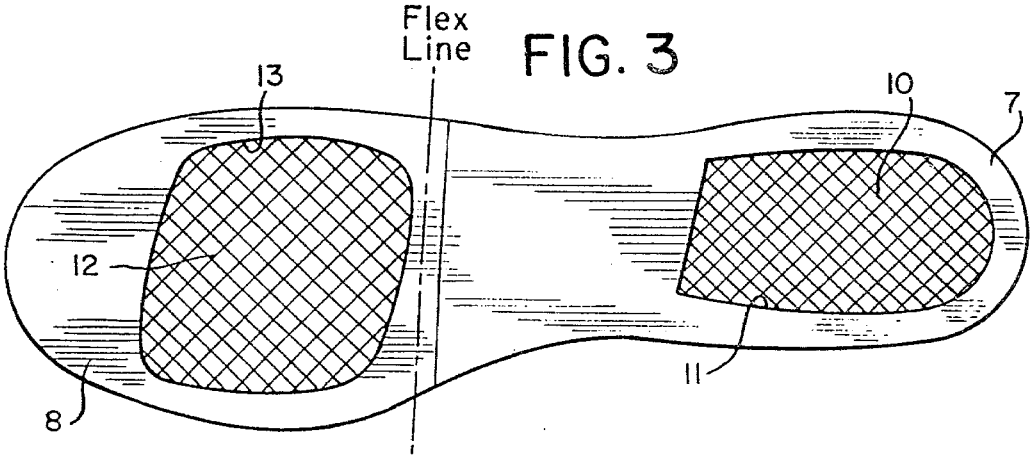
FIG. 3 is a broken view of the bottom of the shoe of FIG. 1 with the outer sole removed.

Referring to FIG. 1, there is illustrated a shoe constructed according to the invention having a sole portion 1 which is connected to a conventional upper portion 2. As shown in FIG. 2, the sole portion comprises an outer rubber sole 3 having a heel area 4, an arch area 5 and a forefoot area 6. A heel wedge 7 overlies the arch area 5 and heel area 4 and a mid-sole 8 overlies the forefoot area 6 and heel wedge 7. A first shock absorbing portion 10 is included within a cut out 11 of the heel wedge and is positioned over the heel area 4 of the outer sole 3. A second shock absorbing portion 12 is contained within a cut out 13 of the mid-sole 8 and is positioned over the forefoot area 6 of the outer sole.

A shoe lasting material 15 comprising a relatively stiff paper board-like material overlies the mid-sole.

Shock absorbing portions 10 and 12 are preferably made of a complex compound comprising rubber and/or a plastic material blown with nitrogen to form a foam material and each has a particular degree of hardness. Preferably the first shock absorbing portion 10 in the heel area which is subjected to the more instantaneous shock loads and thus loads of high intensity has a higher hardness to control energy expenditure while the second shock absorbing portion 12 in the forefoot area which is subjected to longer duration shock loads of lower intensity has a lower hardness to be more comfortable and conformable to the forefoot. Shock absorbing portions 10 and 12 further have the property that they will set approximately 10–20% of original thickness after a prolonged period of use such that the sole of the shoe becomes self-conforming to an extent to the foot of the wearer thus increasing comfort to the wearer.

The heel wedge is of a harder rubber foam material than either of the shock absorbing portions to promote lateral stability and shank support. The heel wedge thus provides sufficient support for the arch area and at the same time provides a support for the back or tip of the heel of the outer shell which receives the initial contact with the ground. The heel wedge also provides support on the outer edge of the arch so as to prevent tipping of the shoe and foot when the outer area of the arch of the shoe contacts the ground after the heel area contacts the ground.

The mid-sole 8 comprises a rubber and/or plastic foam material which is softer and more elastic than the heel wedge in order to provide sufficient adaptation and propulsive effect for the front of the shoe. The mid-sole is, however, flexible enough to bend under the weight of the wearer so as to evenly engage the top of the shock absorbing portions 10 and 12 under varying loads as well as to maintain a smooth rolling transition of forces from touchdown of the heel through toeoff.

The shoe lasting material 15 comprising the board-like material has a plurality of laterally extending score lines 20 positioned in the forefoot area and which extend substantially parallel to a breakline of flex line corresponding to the joint between the metatarsus and the phalanges of the foot of the wearer. These score lines facilitate easy flexing of the innersole along the breakline. The score lines also help prevent other solid areas of the lasting material from breaking down and thus help to maintain shank support. In addition longitudinally extending score lines 21 are also positioned in the forefoot area and allow, in combination with the score lines 20, for the board-like material to deflect to assure contact with the upper surface of the shock absorbing portion 12 under varying load conditions and as the shock absorbing portion 12 sets after prolonged use.

Laterally extending score lines 22 and longitudinally extending score lines 23 are contained in the innersole in the heel area to also allow that portion of the innersole to deflect to assure even contact with the mid-sole under varying load conditions and to accommodate setting of the first shock absorbing portion 10 after prolonged use. In addition, the score lines also provide a further shock absorption feature.

Figure 4:
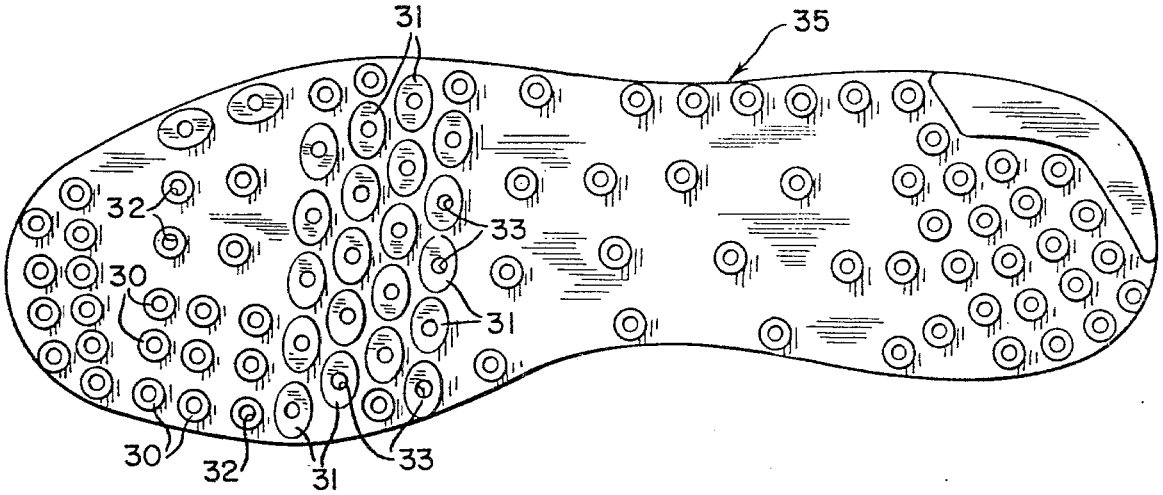
FIG. 4 is a bottom view of the shoe of FIG. 1.

Referring to FIG. 4 a plurality of circular nubs 30 and elliptical shaped nubs 31 are shown molded to the bottom of the outer sole. The nubs 30 and 31 may have negative depressions 32 and 33 therein to increase flexure properties of the nubs and to further provide a further cushioning and traction feature. As shown, the nubs in the heel and forefoot areas are positioned closer together than the nubs in the arch area. This is to compensate for the fact that greater loads, both vertical and sliding are imparted to the heel and forefoot area than to the arch area. Nubs are positioned closely together at the outer edge 35 of the arch area to compensate for the fact that the outer edge of this area of the sole contacts the ground after the heel area. Reducing the number of nubs in the arch area and particularly on the inside of the arch area reduces overall weight of the shoe, which as in the case of running shoes, is an extremely important requirement.

As shown the major axis of the elliptical-shaped nubs 31 extend substantially laterally of the sole and parallel to the natural breakline of the joint between the metatarsus and phalanges of the foot of the wearer. This results in that the longitudinal spacing between the nubs is also parallel to the breakline and so allows easy flexing of the sole. The nubs are elliptical in the forefoot area in order to provide greater traction with the ground.

Figure 5:
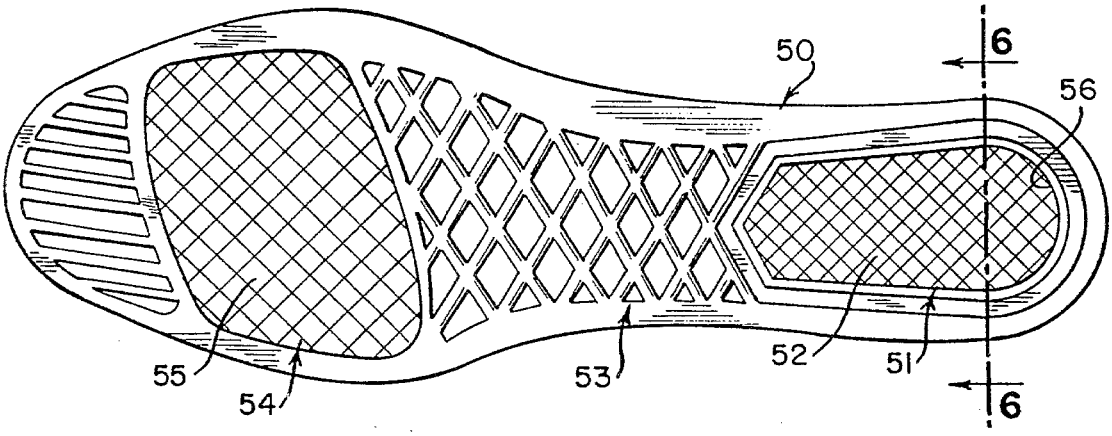
FIG. 5 is a bottom view of a further embodiment of an athletic shoe constructed according to the invention.
Figure 6:
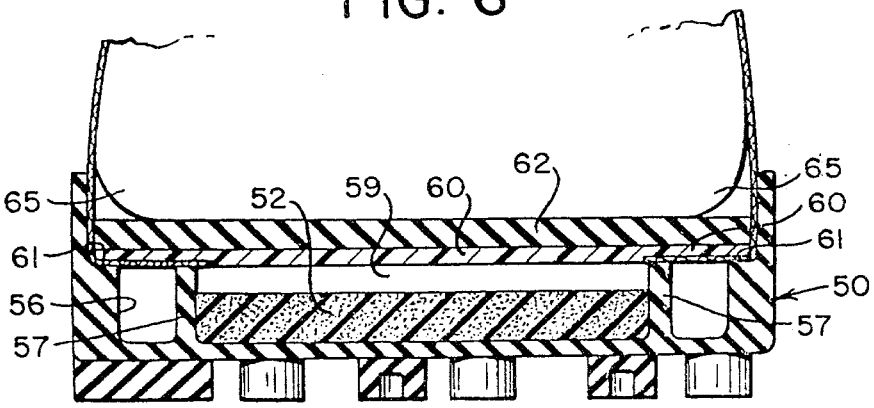
FIG. 6 is a sectional view of the shoe of FIG. 5 taken along lines 6—6.

Referring to FIGS. 5 and 6 a further embodiment of the shoe construction is illustrated. There an outer or sole shell 50 has a heel area 51 containing a first shock absorbing portion 52, an arch area 53 and a forefoot area 54 containing a second shock absorbing portion 55. The shock absorbing portion 55 is of a less degree of hardness than the shock absorbing portion 52 in the same manner as with the shoe of FIG. 1 and the shock absorbing portions may be constructed of the same material as with the shoe of FIG. 1.

As shown in FIG. 6, the outer shell 50 has a curved cut out 56 therein including a curved upstanding deflection rib 57. The shock absorbing portion 52 is positioned within the interior of the cut out so as to engage the ribs 57 and extends beneath the top of the rib 57 so as to leave a small space 59. A shoe lasting material 60 similar to that of the shoe of FIG. 1 extends over the heel area and contacts a shoulder 61 contained within the sole shell 50 as well as the top of the upstanding deflection rib 57. An innersole 62 comprising a soft foam material overlies the mid-sole. Under a shock load, as when the heel of the shoe contacts the ground, the rib 57 will bow or deflect outwaardly allowing the shoe lasting material 60 to contact the upper surface of the shock aborbing portion 52.

As the weight of the wearer is shifted over to the forefoot area, the rib 57 will spring back to the shape as shown in FIG. 6 imparting a propulsive force to the shoe lasting material which is transmitted through the innersole 62 to the heel 65 of the wearer.

Figure 7:
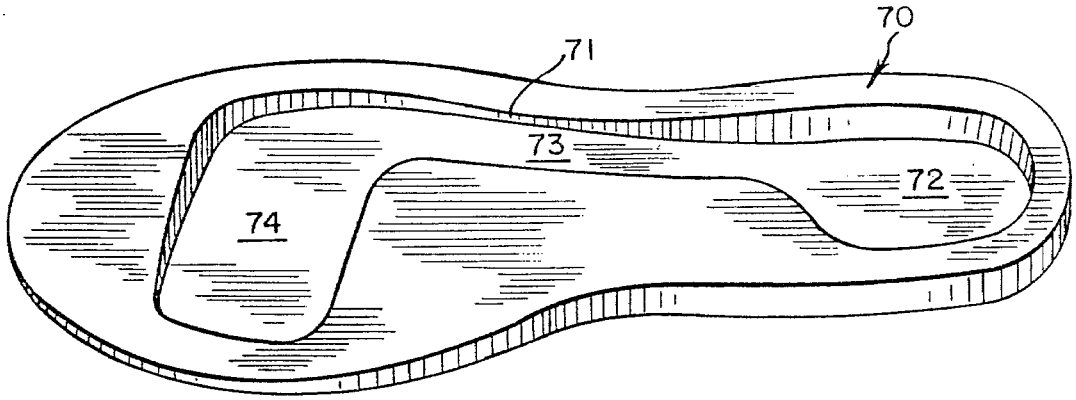
FIG. 7 is a perspective view of a sole shell comprising part of a sole portion of an athletic shoe constructed according to the invention.
Figure 9:
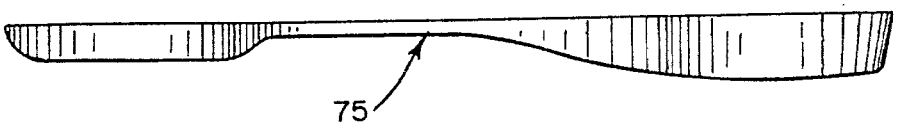
FIG. 9 is a side view of the insert of FIG. 8.

Referring to FIG. 7 there is illustrated a sole shell 70 adapted to form part of a sole portion of an athletic shoe and which has a cavity 71 therein. The cavity 71 has a heel area 72, an arch area 73 and a forefoot area 74 with the cavity being considerably deeper in the heel area 72 than in the arch or forefoot areas. A shock absorbing insert 75 comprised of a rubber and/or plastic material is adapted to be received into the cavity 71 so as to be flush with the top of the sole shell. As shown in FIG. 9, the insert 75 is thicker where it engages the heel area 72 and thinner where it engages the forefoot area 74. The result is that the shock absorbing property of the part of the insert engaging the heel area 72 will be greater, since it is thicker, than the shock absorbing property of that part of the insert engaging the forefoot area.

Figure 10:
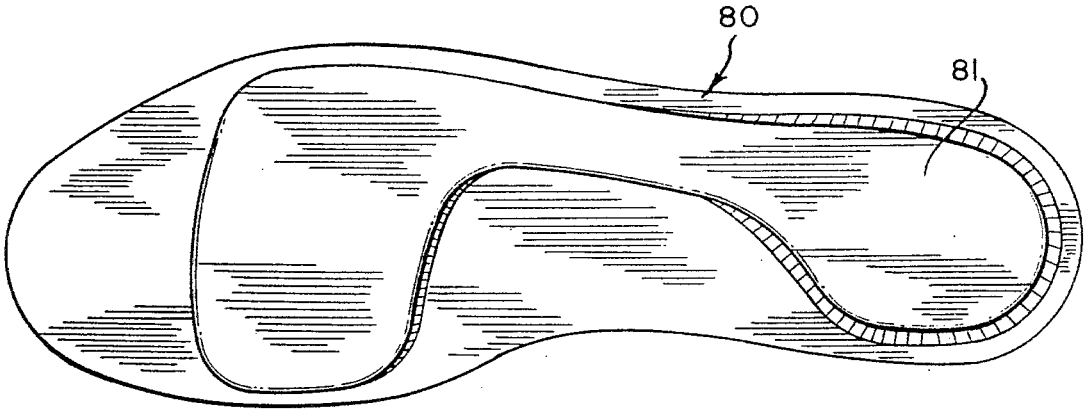
FIG. 10 is a plan view of a mid-sole comprising part of a sole portion of an athletic shoe constructed according to the invention.
Figure 11:
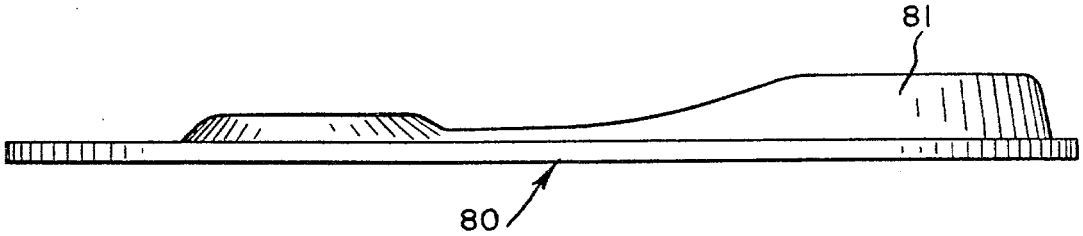
FIG. 11 is a side view of the mid-sole of FIG. 10.

Referring to FIG. 10 there is illustrated a mid-sole 80 having a contoured shock insert portion 81 similar generally in shape and configuration to the insert 75. When the mid-sole 80 is used in a shoe construction, the insert 81 is adapted to be received into the cavity of a sole shell similar to that of FIG. 7 and such that the mid-sole will extend over the complete sole shell.

Figure 8:
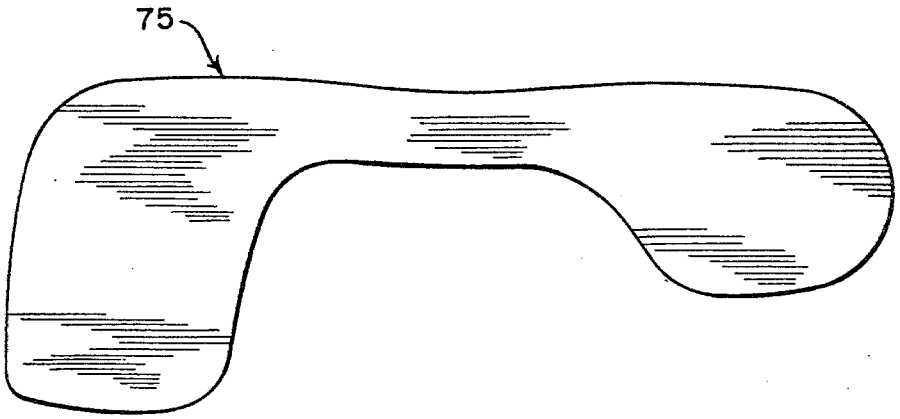
FIG. 8 is a plan view of a shock absorbing insert adapted to be received in the sole shell of FIG. 7.

With both the shock absorbing insert of FIG. 8 and with the mid-sole of FIG. 10, the precise configuration of the portion providing the shock absorbing feature can be easily shaped to fit various foot sizes and configurations, all that is required is that the sole shell have a conforming shaped cavity. The insert or mid-sole portion including the contoured insert may be formed either by molding or by die-cutting.

Figure 12:
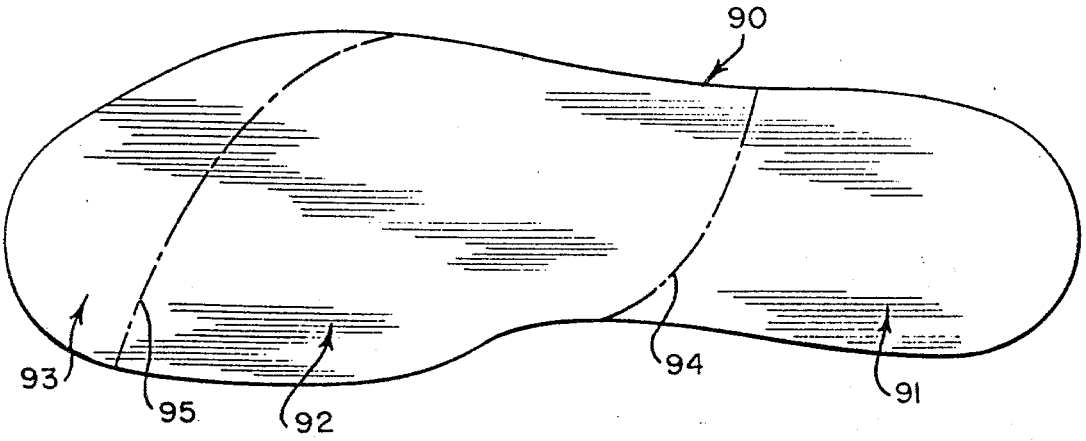
FIG. 12 is a plan view of a further form of mid-sole for use in the sole portion of an athletic shoe constructed according to the invention.

The mid-sole 90 of FIG. 12 is a flat mid-sole of constant thickness and comprises a heel area 91, a forefoot area 92 and a toe area 93 each of which is made up of a shock absorbing material having different degrees of hardness with the requirement that the material making up the forefoot portion 92 is softer than the material making up the heel area 91. In addition the material making up the toe area 93 should have springy characteristics to provide a spring propulsion effect when compressive forces are removed. The lines 94 and 95 separating the heel, forefoot and toe portions can be varied so as to easily accommodate shoes designed for different sports where the shock loads between heel, forefoot and toe portions may vary due to the nature of the sport. The mid-sole 90 is adapted for use within either a sole shell or to be included over an outer sole and heel wedge as in the general configuration as shown in FIG. 1.

Athletic shoes constructed according to the invention provide the varying degree of cushioning needed to compensate for the different shock loads produced as different portions of the shoe contact the ground during running or other athletic endeavors. Further such shoes provide a slight propulsive force to assist the wearer as weight is moved from the heel portion of the foot forward to the forefoot portion of the foot. The particular construction also compensates for the fact that while different people may have the same size foot, the positioning of the joint between the metatarsus and phalanges will vary greatly among people thus requiring different breaklines in soles of shoes of the same size.

We claim:

1. In an athletic shoe construction having a sole portion connected to an upper portion and where said sole portion includes a heel area, an arch area and a forefoot area; the improvement comprising in that said sole portion includes an insert in said heel area forming a first shock absorbing portion having a first degree of shock absorbing property and in said forefoot area forming a second shock absorbing portion having a second degree of shock absorbing property less than said first degree.

2. In an athletic shoe construction according to claim 1, the improvement further comprising in that said first shock absorbing portion has a first degree of hardness and in that said second shock absorbing portion has a second degree of hardness less than said first degree of hardness.

3. In an athletic shoe construction according to claim 2, the improvement further comprising in that said sole portion includes a heel wedge of a third degree of hardness greater than said first degree of hardness overlying said arch and heel areas and engaging the periphery of said first shock absorbing portion.

4. In an athletic shoe construction according to claim 3, the improvement further comprising in that said sole portion includes a mid-sole overlying said forefoot area, said heel wedge and first shock absorbing portion and engaging the periphery of said second shock absorbing portion.

5. In an athletic shoe construction according to claim 4, the improvement further comprising in that said sole portion includes a shoe lasting material overlying said mid-sole wherein said material has a plurality of substantially laterally extending score lines in the area of and substantially parallel with the natural breakline between the metatarsus and phalanges of the foot of a wearer to facilitate the flexing of said sole portion along said breakline.

6. In an athletic shoe construction according to claim 5, the improvement further comprising in that said material has longitudinally extending score lines adjoining with said laterally extending score lines whereby said material overlying said second shock absorbing portion may be readily deformed to engage said second shock absorbing portion.

7. In an athletic shoe construction according to claim 6, the improvement further comprising in that said material has a plurality of longitudinally and laterally extending score lines overlying said first shock absorbing portion whereby said material overlying said first shock absorbing portion may be readily deformed to engage said first shock absorbing portion.

8. In an athletic shoe construction according to claim 2, the improvement further comprising in that said shock absorbing portions comprise materials which have approximately a 10–20% set when subjected to the weight of a wearer over a substantial period of time whereby said shock absorbing portions become substantially self-conforming in shape.

9. In an athletic shoe construction according to claim 2, the improvement further comprising in that said sole portion includes a mid-sole forming part of said heel area, said arch area and said forefoot area and wherein part of the mid-sole forming part of said heel area contains said first shock absorbing portion and part of said mid-sole forming part of said forefoot area contains said second shock absorbing portion.

10. In an athletic shoe construction according to claim 9, the improvement further comprising in that said sole portion includes in addition a toe area and wherein said mid-sole forms part of said toe area and wherein the part of said mid-sole forming part of said toe area includes a spring material portion comprising a springy material.

11. In an athletic shoe construction according to claim 1, the improvement further comprising in that said sole portion includes a sole shell having a cavity therein at said heel area, said arch area and said forefoot area, in that said shock absorbing insert is fitted into said cavity and in that the thickness of the insert at the heel area is greater than the insert at the forefoot area such that the shock absorbing properties in the heel area are greater than the shock absorbing properties in the forefoot area.

12. In an athletic shoe construction according to claim 1, the improvement further comprising in that said sole portion includes a mid-sole having a cavity therein at said heel area, said arch area and said forefoot area, in that said shock absorbing insert is fitted into said cavity and in that the thickness of the insert at the heel area is greater than the thickness of the insert at the forefoot area such that the shock absorbing properties in the heel area are greater than the shock absorbing properties in the forefoot area.

13. In an athletic shoe construction having a sole portion including a heel area, the improvement comprising in that said heel area has a cut out therein which includes a vertically extending deflection rib spaced from vertically extending sides of said cut out, a shock absorbing portion within said cut out and engaging vertical sides of said deflection rib with the top of the shock absorbing portion extending below the top of said rib, and a deformable shoe lasting material overlying said heel area engaging the top of said deflection rib and being spaced from said shock absorbing portion under no load conditions and engaging the top of said shock absorbing portion under load conditions.

14. In an athletic shoe construction according to claim 13, the improvement further comprising in that a part of said cut out, a part of said shock absorbing portion and a part of said deflection rib are circular and in that a part of the space between the upstanding rib and the side walls of the cut out is annular.

15. In an athletic shoe construction having a sole portion connected to an upper portion and where the sole portion includes a heel area, an arch area, a forefoot area and an outer sole; the improvement comprising in that said outer sole has a plurality of flexible nubs on the outer side thereof, in that the spacing between the nubs is greater in the arch area than in the forefoot and the heel areas, in that the nubs in the arch area and in the heel area are circular in shape, and in that the nubs at the portion of the outer sole corresponding to the natural breakline between the metatarsus and the phalanges of a foot of a wearer are elliptical in shape with the major axes of the elliptical shapes extending substantially parallel to said natural breakline to facilitate flexing of said sole portion along said breakline.

* * * * *